US008797256B2

(12) United States Patent
Nam et al.

(10) Patent No.: US 8,797,256 B2
(45) Date of Patent: Aug. 5, 2014

(54) ELECTROPHORESIS DISPLAY

(75) Inventors: Seungseok Nam, Seoul (KR); Chulkwon Lee, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 931 days.

(21) Appl. No.: 12/619,666

(22) Filed: Nov. 16, 2009

(65) Prior Publication Data

US 2010/0134504 A1 Jun. 3, 2010

(30) Foreign Application Priority Data

Dec. 3, 2008 (KR) ..... 10-2008-0122148

(51) Int. Cl.
*G09G 3/34* (2006.01)
*G09G 3/20* (2006.01)

(52) U.S. Cl.
CPC ..... *G09G 3/344* (2013.01); *G09G 3/2092* (2013.01); *G09G 2340/16* (2013.01); *G09G 2360/18* (2013.01)
USPC ..... 345/107; 345/204; 345/690

(58) Field of Classification Search
CPC ..... G09G 2340/16; G09G 2360/18; G09G 3/2092; G09G 3/344
USPC ..... 345/1.1–3.4, 536, 530, 558, 107; 711/5; 359/296
See application file for complete search history.

(56) References Cited

U.S. PATENT DOCUMENTS 6,084,637 A * 7/2000 Oku et al. ..... 348/445
6,383,771 B1 * 5/2002 Birkmayer ..... 435/25
6,583,771 B1 * 6/2003 Furuhashi et al. ..... 345/1.1
7,012,600 B2 * 3/2006 Zehner et al. ..... 345/214
7,242,370 B2 * 7/2007 Ouchi et al. ..... 345/1.3
7,528,822 B2 * 5/2009 Amundson et al. ..... 345/107
7,868,869 B2 * 1/2011 Shin et al. ..... 345/107
8,054,288 B2 * 11/2011 Sugita et al. ..... 345/107
8,102,363 B2 * 1/2012 Hirayama ..... 345/107
8,174,494 B2 * 5/2012 Kanbayashi et al. ..... 345/107
8,179,387 B2 * 5/2012 Shin et al. ..... 345/208
2002/0005832 A1 * 1/2002 Katase ..... 345/107
2002/0106198 A1 * 8/2002 Suzuki ..... 386/111
2003/0137521 A1 * 7/2003 Zehner et al. ..... 345/589
2003/0226064 A1 * 12/2003 Nakazawa ..... 714/42
2004/0119680 A1 * 6/2004 Daniel et al. ..... 345/107
2004/0125066 A1 * 7/2004 Park et al. ..... 345/92

(Continued)

FOREIGN PATENT DOCUMENTS

WO WO 2005/043504 A1 5/2005
WO WO-2009/101851 A1 8/2009

*Primary Examiner* — Quan-Zhen Wang
*Assistant Examiner* — Chun-Nan Lin
(74) *Attorney, Agent, or Firm* — Birch, Stewart, Kolasch & Birch, LLP

(57) ABSTRACT

An electrophoresis display is provided to reduce writing time of a memory. The electrophoresis display includes: an electrophoresis display panel; a first memory and a second memory for alternatively storing a previous state image and a current state image; and a controller sets the first digital data generated by the system as the current state image and stores it alternately in one of the first and second memories every cycle, keeps storing the first digital data previously stored in the other one of the first and second memories in it as the previous state image, compares the current state image and the previous state image, and generates second digital data to be displayed on the electrophoresis display panel by use of waveform information corresponding to the result of the comparison among the plurality of waveform information.

5 Claims, 5 Drawing Sheets

(56) References Cited

U.S. PATENT DOCUMENTS

| | | | | |
|---|---|---|---|---|
| 2005/0001812 | A1* | 1/2005 | Amundson et al. | 345/107 |
| 2005/0018521 | A1* | 1/2005 | Lee et al. | 365/230.03 |
| 2006/0139310 | A1* | 6/2006 | Zehner et al. | 345/107 |
| 2006/0139311 | A1* | 6/2006 | Zehner et al. | 345/107 |
| 2006/0209011 | A1* | 9/2006 | Miyasaka | 345/107 |
| 2006/0232531 | A1* | 10/2006 | Amundson et al. | 345/87 |
| 2007/0058476 | A1* | 3/2007 | Nakazawa | 365/230.08 |
| 2007/0156946 | A1* | 7/2007 | Lakshmanamurthy et al. | 711/5 |
| 2007/0236432 | A1* | 10/2007 | Benjamin et al. | 345/87 |
| 2007/0273637 | A1 | 11/2007 | Zhou et al. | |
| 2009/0150701 | A1* | 6/2009 | Nagao et al. | 713/324 |
| 2009/0256798 | A1 | 10/2009 | Low et al. | |
| 2009/0262590 | A1* | 10/2009 | Nakazawa | 365/189.14 |
| 2011/0193840 | A1* | 8/2011 | Amundson et al. | 345/208 |
| 2011/0193841 | A1* | 8/2011 | Amundson et al. | 345/208 |
| 2011/0199287 | A1* | 8/2011 | Benjamin et al. | 345/87 |

* cited by examiner

ELECTROPHORESIS DISPLAY

This application claims the benefit of Korean Patent Application No. 10-2008-0122148 filed on Dec. 3, 2008, which is incorporated herein by reference for all purposes as if fully set forth herein.

BACKGROUND OF THE INVENTION

1. Field of the Invention

This document relates to an electrophoresis display, and more particularly, to an electrophoresis display which can reduce writing time of a memory.

2. Discussion of the Related Art

If a material having electric charge is placed in an electric field, the material peculiarly moves in accordance with electric charges, the size and shape of molecules and the like. Such a movement, i.e., a phenomenon in which materials are separated by the difference of movement, is named 'Electrophoresis'. Recently, a display using electrophoresis has been developed and attention has been paid thereto as a medium with which a conventional paper medium or display could be replaced.

The display using electrophoresis has been disclosed in U.S. Pat. Nos. 7,012,600 and 7,119,772. The disclosed electrophoresis display compares current state images with next state images for each cell by use of a look-up table (LUT) 1, a plurality of memories 2 to 4, and a frame counter 5, as shown in FIG. 1, thereby determining the data V1 to Vn which are to be supplied to each cell for a plurality of frame periods.

The data V1 to Vn outputted from the look-up table 1 are digital data such as '00', '01', '10' and '11', and are changed to voltages of three states which are applied to a pixel electrode of each cell, that is, Ve+(+15V), Ve−(−15V), and Ve0 (0V). '00' and '11' in the digital data is changed to Ve0(0V), '01' is changed to Ve+(+15V), and '10' is changed to Ve−(−15V).

FIG. 2 shows an example of a drive waveform which is supplied for a plurality of frame periods in accordance with a data written in the previous state and a data to be written in the current state. In FIG. 2, 'W(11)' represents a peak white gray level, 'LG(10)' represents a bright intermediate gray level, 'DG(01)' represents a dark intermediate gray level, and 'B(00)' represents a peak black gray level. And, the number written under the drive waveform is the number of frames.

A DC common voltage Vcom is supplied to a common electrode which is opposite to a pixel electrode. A positive data voltage Ve+ supplied to the pixel electrode is a voltage which is higher than the DC common voltage Vcom, and a negative data voltage Ve− is a voltage which is lower than the DC common voltage Vcom.

Such an electrophoresis display has the following problems.

As shown in FIG. 3, when display data is changed in a display panel every k (k is a natural number) frame periods, a control block 6 sets image data supplied from a system 5 during the current cycle as a current state image and stores it in a second memory 3, and sets the image data stored in the second memory 3 during the previous cycle as a previous state image and stores it in a first memory 2. The control block 6 compares the image data stored in the first and second memories 2 and 3, and generates digital data to be supplied to a data driving circuit by use of waveform information corresponding to the result of the comparison. And, the control block 6 sets image data supplied from the system 5 during the next cycle subsequent to the current cycle as the current state image to update the second memory 3, and sets the image data stored in the second memory 3 during the current cycle as the previous state image to update the first memory 2. The control block 6 compares the image data stored in the first and second memories 2 and 3, and generate digital data to be supplied to the data driving circuit by use of waveform information corresponding to the result of the comparison.

As seen from above, the electrophoresis display of the related art includes a first memory 2 for storing a previous state image only and a second memory 3 for storing a current state image only, and updates the first memory 2 and the second memory 3 every k frame periods so as to display image data on a display panel, thus increasing memory writing time and making driving complicated.

SUMMARY OF THE INVENTION

An aspect of this document is to provide an electrophoresis display which can reduce memory writing time and decrease the driving load required for a memory writing operation.

To achieve the above aspect, there is provided an electrophoresis display according to an exemplary embodiment of the present invention, including: an electrophoresis display panel having a plurality of data lines and a plurality of gate lines which cross each other and a plurality of electrophoresis cells; a first memory and a second memory for alternatively storing a previous state image and a current state image; a system for sequentially generating first digital data every cycle; a mode table for storing a plurality of waveform information; and a controller which sets the first digital data generated by the system as the current state image and stores it alternately in one of the first and second memories every cycle, keeps storing the first digital data previously stored in the other one of the first and second memories in it as the previous state image, compares the current state image and the previous state image, and generates second digital data to be displayed on the electrophoresis display panel by use of waveform information corresponding to the result of the comparison among the plurality of waveform information. The cycle includes k frame periods.

The controller includes: a first memory control unit for writing and reading the first memory; a second memory control unit for writing and reading the second memory; a storage memory selection unit for alternately operating the first and second memory control units every cycle for the writing operation; and a data generator for simultaneously receiving the current state image and the previous state image through the first and second memory control units, comparing the current state image and the previous state image, and generating the second digital data according to the result of the comparison. The controller further comprises a frame counter for counting the number of frames and generating information of the number of frame periods, wherein, the storage memory selection unit alternately operates the first and second memory control units every k frame periods for the writing operation based on the information of the number of frame periods.

The first memory control unit is operated during a writing period in a first cycle to set the first digital data generated by the system at the first cycle as the current state image and write the first digital data in the first memory; and the second memory control unit is operated during a writing period in a second cycle to set the first digital data generated by the system at the second cycle as the current state image and write the first digital data in the second memory.

The first digital data stored in the second memory during the previous cycle right before the first cycle is re-set as the previous state image during the first cycle and then maintained in the second memory; and the first digital data stored in the first memory during the previous cycle right before the second cycle is re-set as the previous state image during the second cycle and then maintained in the first memory. The first and second memory control units are simultaneously operated during the reading period in all cycles and read out the first digital data stored in the first memory or the second memory, respectively. The controller further includes a buffer unit for buffering a difference between the input timing of the first digital data from the system and the read and write timing of the first digital data of the first memory or the second memory. The buffer unit includes a First In First Out (FIFO) buffer.

To achieve the above aspect, there is also provided a display method for an electrophoresis display, which includes an electrophoresis display panel and a first memory and a second memory for alternatively storing a previous state image and a current state image, comprising: sequentially generating first digital data every cycle; setting the first digital data as the current state image and storing it alternately in one of the first and second memories every cycle; keeping storing the first digital data previously stored in the other one of the first and second memories in it as the previous state image; comparing the current state image and the previous state image; and generating second digital data to be displayed on the electrophoresis display panel by use of waveform information corresponding to the result of the comparison.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, an implementation of this document will be described in detail with reference to FIGS. 4 to 7.

Figure 1:
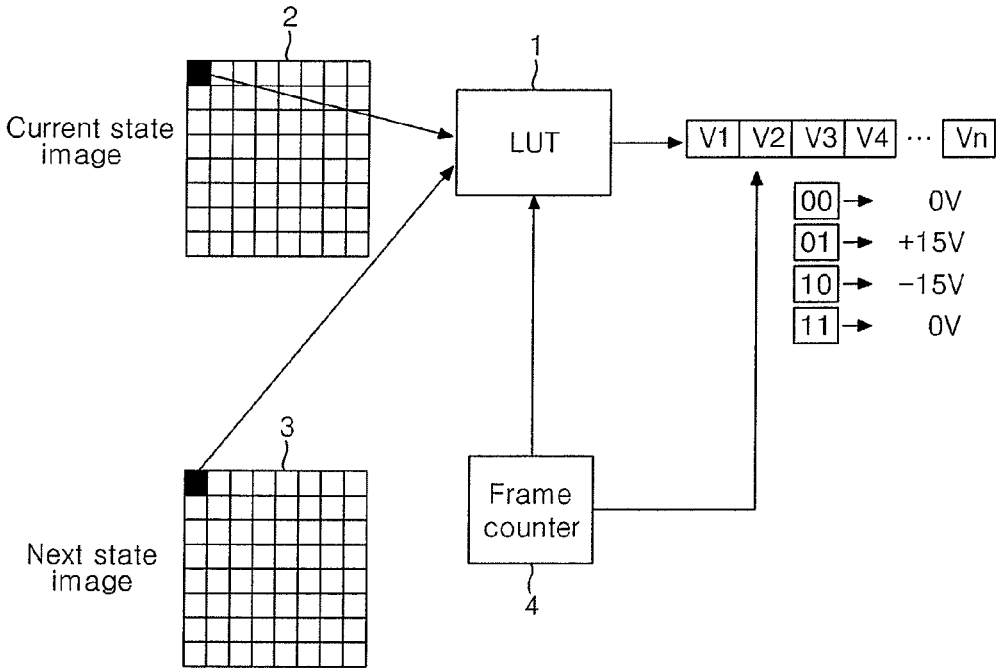
FIG. 1 (Related Art)
FIG. 1 is a diagram schematically showing a conventional electrophoresis display.
Figure 2:
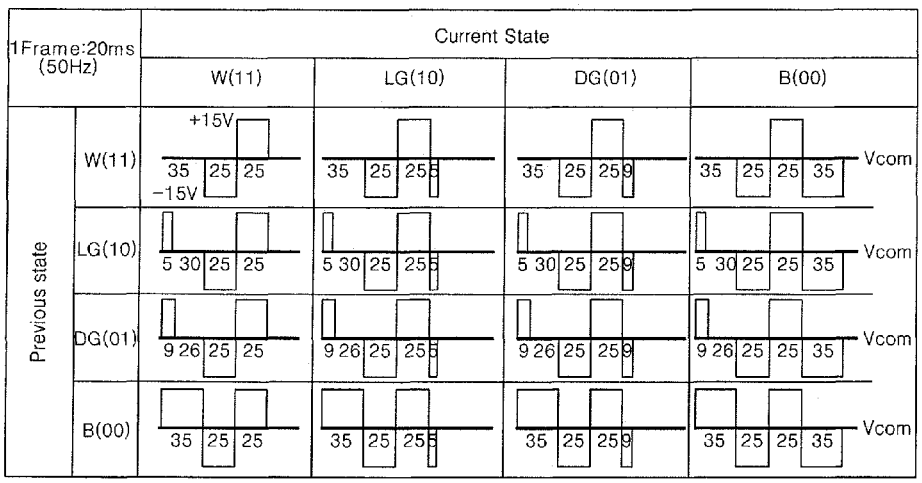
FIG. 2 (Related Art)
FIG. 2 is a diagram showing an example of a data voltage waveform registered in a look-up table shown in FIG. 1.
Figure 3:
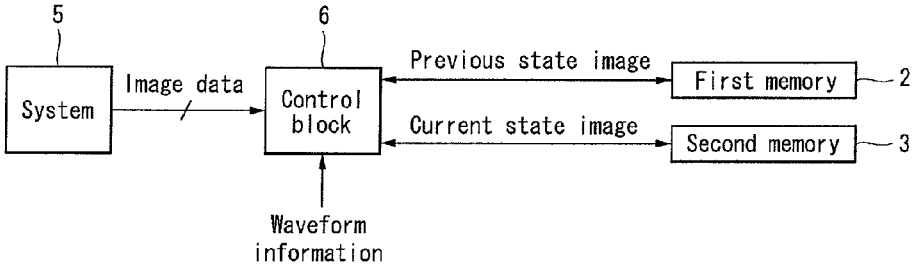
FIG. 3 (Related Art)
FIG. 3 is a diagram for explaining data update for a memory in the conventional electrophoresis display.
Figure 4:
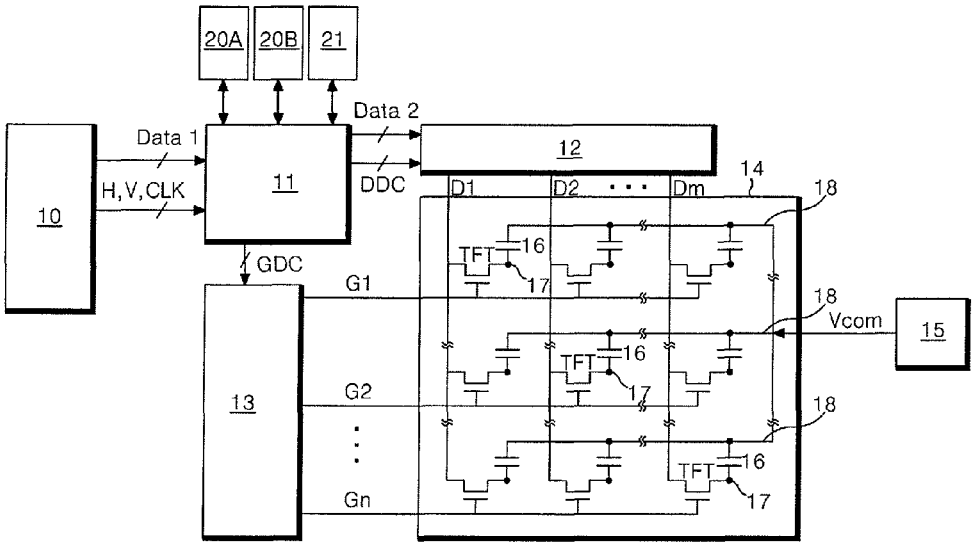
FIG. 4 is a block diagram showing an electrophoresis display according to an exemplary embodiment of the present invention.
Figure 5:
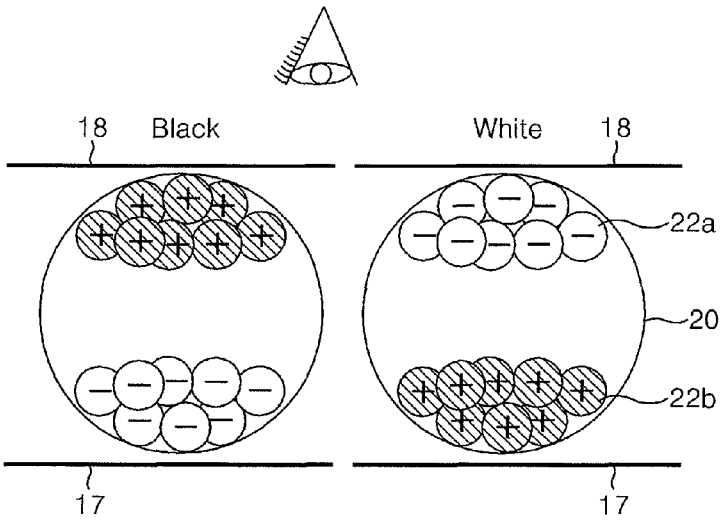
FIG. 5 is a diagram showing in detail a microcapsule structure of a cell shown in FIG. 4.

FIG. 4 and FIG. 5 show an electrophoresis display and a cell according to an exemplary embodiment of the present invention.

Referring to FIG. 4 and FIG. 5, the electrophoresis display according to the exemplary embodiment of the present invention includes: a system 10 for generating first digital data Data1 and timing signals H, V, and CLK; an electrophoresis display panel 14 where m×n number of cells 16 are arranged; a data driving circuit 12 for supplying data voltages to data lines D1 to Dm of the electrophoresis display panel 14; a gate driving circuit 13 for supplying scan pulses to gate lines G1 to Gn of the electrophoresis display panel 14; a common voltage generation circuit 15 for supplying common voltages Vcom to a common electrode 18 of the electrophoresis display panel 14; a timing controller 11 for controlling the driving circuits 12 and 13; memories 20A and 20B for storing the first digital data Data1; and a waveform information table 21 for storing waveform information.

The system 10 generates first digital data Data1 and timing signals H, V, and CLK.

The electrophoresis display panel 14 has a plurality of microcapsules 20 interposed between two substrates, as in FIG. 5. Each of the microcapsules 20 includes white particles 22*a* which are electrically charged to be negative (−) and black particles 22*b* which are electrically charged to be positive (+). The m number of data lines D1 to Dm and the n number of gate lines G1 to Gn which are formed on a lower substrate of the electrophoresis display panel 14 are made to cross each other. Thin film transistors (hereinafter, referred to as "TFT") are connected in intersections of the data lines D1 to Dm and the gate lines G1 to Gn. A source electrode of the TFT is connected to the data line D1 to Dm and a drain electrode thereof is connected to a pixel electrode 17 of a cell 16. And, a gate electrode of the TFT is connected to the gate line G1 to Gn. The TFT is turned on in response to a scan pulse from the gate line G1 to Gn, thereby selecting cells 16 of one line which are intended to be displayed. A common electrode 18 is formed on an upper transparent substrate of the electrophoresis display panel 14 for simultaneously supplying the common voltage Vcom to all the cells.

On the other hand, the microcapsules 20 may include the positively charged white particles and the negatively charged black particles. In this case, the phase and voltage of a drive waveform may be changed.

The timing controller 11 receives vertical/horizontal synchronization signals V, H and a clock signal CLK from the system 10, and generates a data control signal DDC for controlling an operation timing of the data driving circuit 12 and a gate control signal GDC for controlling an operation timing of the gate driving circuits 13. Further, the timing controller 11 stores the first digital data supplied from the system 10 in any one of the first and second memories 20A and 20B, and switches the memories every k frame periods. Accordingly, the first digital data Data1 supplied from the system 10 during the current cycle is stored as a current state image in the first memory 20A, and the first digital data Data1 stored in the second memory 20B during the previous cycle right before the current cycle is kept stored as a previous state image in the second memory 20B. And, the first digital data Data1 supplied from the system 10 during the next cycle subsequent to the current cycle is stored as the current state image in the second memory 20B, and the first digital data Data1 stored in the first memory 20A during the current cycle is kept stored as the previous state image in the first memory 20A. The timing controller 11 compares the digital data stored in the first and second memories 20A and 20B during each cycle, and generates second digital data Data2 to be displayed on the electrophoresis display panel by use of waveform information corresponding to the result of the comparison. The second digital data Data2 is then supplied to the data driving circuit 12.

The data driving circuit 12 has a plurality of data drive integrated circuits, each of which includes a shift register, a latch, a decoder, a level shifter, etc. The data driving circuit 12 latches the second digital data Data2 under control of the timing controller 11, converts the second digital data Data2 into appropriate voltages, that is, Ve+(+15V), Ve−(−15V), and Ve0(0V) through the decoder and the level shifter, and then supplies the voltages to the data lines D1 to Dm.

The gate driving circuit 13 has a plurality of gate drive integrated circuits, each of which includes a shift register, a level shifter for converting a swing width of an output signal of the shift register into a swing width which is suitable for driving the TFT, and an output buffer being connected between the level shifter and the gate line G1 to Gn. The gate driving circuit 13 sequentially outputs the scan pulses synchronized with the data voltages supplied to the data lines D1 to Dm under control of the timing controller 11.

The common voltage generation circuit 15 generates a common voltage Vcom and supplies it to the common electrode 18.

The waveform information table 21 stores a plurality of (for example, 16) waveform information in accordance with correlation between a data written in the previous state (i.e., previous state image) and a data to be written in the current state (i.e., current state image). The waveform information table 21 may include a nonvolatile memory capable of updating and erasing data, for example, an EEPROM (Electrically Erasable Programmable Read Only Memory) and/or an EDID ROM (Extended Display Identification Data ROM).

Figure 6:
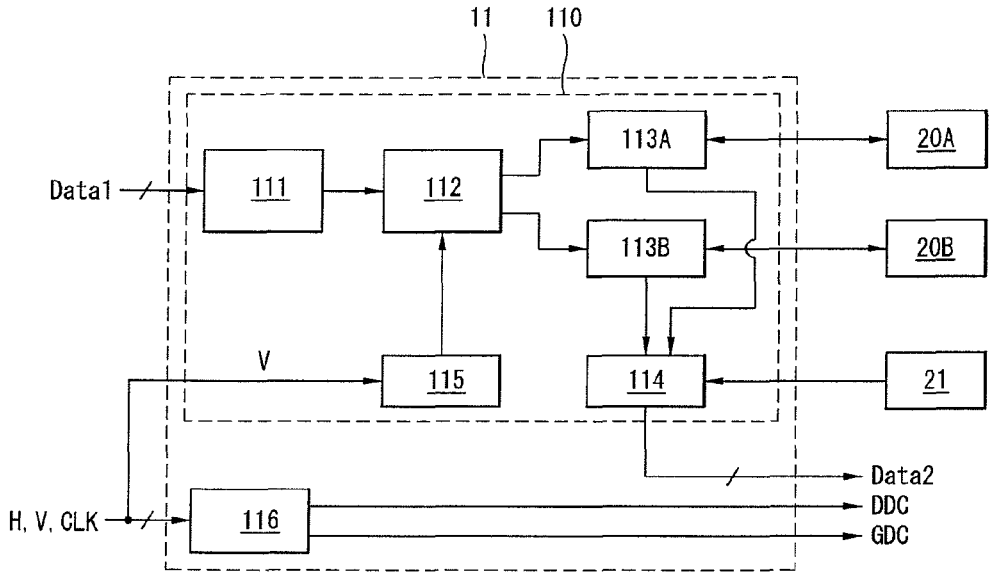
FIG. 6 is a diagram showing in detail a timing controller shown in FIG. 4.

FIG. 6 shows the timing controller 11 of FIG. 5 in detail.

Referring to FIG. 6, the timing controller 11 includes a data generation unit 110 and a control signal generator 116.

The data generation unit 110 includes a buffer unit 111, a storage memory selection unit 112, a first memory control unit 113A, a second memory control unit 113B, a data generator 114, and a frame counter 115.

The buffer unit 111 buffers a difference between the input timing of first digital data Data1 supplied from the system 10 and the read/write timing of the first digital data Data1 of the memories 20A and/or 20B. The buffer unit 111 may include a FIFO (First In First Out) buffer.

Based on information of the number of frame periods from the frame counter 115, the storage memory selection unit 112 selects which of the first and second memories 20A and 20B the first digital data Data1 supplied from the system 10 is to be stored. To this end, the storage memory selection unit 112 forms a first current path to the first memory 20A and a second current path to the second memory 20B, and includes a switching block for switching a current path to be formed every k frame periods. By alternately operating the first memory control unit 113A and the second memory control unit 113B every k frame periods by the storage memory selection unit 112 for the writing operation, the current state image updated every k frame periods is supplied alternately to the first memory 20A and the second memory 20B. Such an operation will be explained in detail later.

The first memory control unit 113A controls the read and write operations of the first memory 20A. The first memory control unit 113A is operated by the first current path during a writing period in the current cycle to set the first digital data Data1 supplied from the system 10 as the current state image and store it in the first memory 20A. At this time, the first digital data Data1 stored in the second memory 20B during the previous cycle right before the current cycle as the current state image is re-set as the previous state image and then still maintained in the second memory 20B.

The second memory control unit 113B controls the read and write operation of the second memory 20B. The second memory control unit 113B is operated by the second current path during a writing period in the next cycle subsequent to the current cycle to set the first digital data Data1 supplied from the system 10 as the current state image and store it in the second memory 20B. At this time, the first digital data Data1 stored in the first memory 20A during the current cycle as the current state image is re-set as the previous state image and then still maintained in the first memory 20A.

The first and second memory control units 113A and 113B are simultaneously operated during the reading period in all cycles and read out the first digital data Data1 stored in the first and second memories 20A and 20B, respectively.

The frame counter 115 counts the number of frame periods with respect to a vertical synchronization signal V and generates information of the number of frame periods, and supplies the information of the number of frame periods to the storage memory selection unit 112.

The data generator 114 compares the first digital data Data1 read out from the first memory 20A and the second memory 20B, that is, image data of the previous state and image data of the current state, and extracts waveform information corresponding to the result of the comparison with reference to the waveform information table 21. And, the data generator 114 generates second digital data Data2 corresponding to the extracted waveform information and supplies it to the data driving circuit 12.

The control signal generator 116 generates a data control signal DDC for controlling an operation timing of the data driving circuit 12 and a gate control signal GDC for controlling an operation timing of the gate driving circuits 13 by use of timing signals, i.e., vertical/horizontal synchronization signals V, H and a clock signal CLK, supplied from the system 10. And, these control signals DDC and GDC are synchronized with the display timing of the second digital data Data2 and supplied to the corresponding driving circuit.

Figure 7:
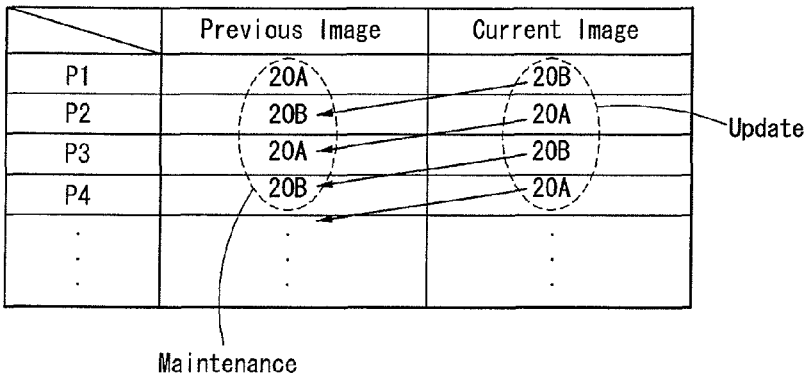
FIG. 7 is a view for explaining data update for a memory in the electrophoresis display according to the exemplary embodiment of the present invention.

FIG. 7 shows a writing operation of the memories according to the exemplary embodiment of the present invention.

Referring to FIG. 7, the electrophoresis display according to the exemplary embodiment of the present invention stores first digital data Data1 updated every predetermined cycle alternately in the first memory 20A and the second memory 20B. For instance, if a previous state image is stored in the first memory 20A and a current state image is stored in the second memory 20B during a first cycle P1, the first digital data Data1 updated and supplied during a second cycle P2 is set as the current state image and then written into the first memory 20A. At this time, the first digital data Data1 stored in the second memory 20B during the first cycle P1 is re-set as the previous state image during the second cycle P2 and then still maintains the value stored by means of the second memory 20B. Then, the first digital data Data1 updated and supplied during a third cycle P3 is set as the current state image and then written into the second memory 20B. At this time, the first digital data Data1 stored in the first memory 20A during the second cycle P2 is re-set as the previous state image during the third cycle P3 and then still maintains the value stored by means of the first memory 20A. Next, the first digital data Data1 updated and supplied during a fourth cycle P4 is set as the current state image and then written into the first memory 20A. At this time, the first digital data Data1 stored in the second memory 20B during the third cycle P3 is re-set as the previous state image during the fourth cycle P4 and then still maintains the value stored by means of the second memory 20B. Therefore, the memory writing time is reduced to a half that of the conventional electrophoresis display.

As stated above, the electrophoresis display according to the present invention can reduce memory writing time to a half that of the conventional electrophoresis display by updating only any one of two memories with newly input digital data, maintaining the existing digital data in the other memory, and switching the memories for update and maintenance alternately every cycle, and, as a result, can decrease as much of the driving load required for memory writing.

It will be understood by those skilled in the art that various changes and modifications may be applicable within a range not departing from the technical idea of the invention. Accordingly, the technical scope of the present invention is not limited to the detailed description of the specification, but should be defined by the accompanying claims.

What is claimed is:

1. An electrophoresis display, comprising:

an electrophoresis display panel having a plurality of data lines and a plurality of gate lines which cross each other and a plurality of electrophoresis cells;

a first memory and a second memory configured to alternatively store a previous state image and a current state image;

a system configured to sequentially generate first digital data every cycle;

a mode table configured to store a plurality of waveform information; and a controller which sets the first digital data generated by the system as the current state image and stores it alternately in one of the first and second memories every cycle, keeps storing the first digital data previously stored in the other one of the first and second memories in it as the previous state image, compares the current state image and the previous state image, and generates second digital data to be displayed on the electrophoresis display panel by use of waveform information corresponding to the result of the comparison among the plurality of waveform information, wherein the controller updates only any one of the first and second memories with the first digital data newly input by the system, and maintains the first digital data previously stored in another one of the first and second memories, and switches the first and second memories for updating and maintaining every cycle, wherein the controller comprises:

a first memory control unit configured to write and read the first memory;

a second memory control unit configured to write and read the second memory;

a storage memory selection unit configured to alternately operate the first and second memory control units every cycle for the writing operation; and a data generator configured to simultaneously receive the current state image and the previous state image through the first and second memory control units, compare the current state image and the previous state image, and generate the second digital data according to the result of the comparison, wherein the first and second memory control units simultaneously read out the first digital data from the first memory and the second memory, respectively, during a reading period in all cycles, wherein the first memory control unit is operated during a writing period in a first cycle to set the first digital data generated by the system at the first cycle as the current state image and write the first digital data in the first memory; and the second memory control unit is operated during a writing period in a second cycle to set the first digital data generated by the system at the second cycle as the current state image and write the first digital data in the second memory, and wherein the first digital data stored in the second memory during the previous cycle right before the first cycle is re-set as the previous state image during the first cycle and then maintained in the second memory; and the first digital data stored in the first memory during the previous cycle right before the second cycle is re-set as the previous state image during the second cycle and then maintained in the first memory.

2. The electrophoresis display of claim 1, wherein one cycle includes k frame periods.

3. The electrophoresis display of claim 1, wherein one cycle includes k frame periods, and the controller further comprises a frame counter for counting the number of frames and generating information of the number of frame periods, and wherein the storage memory selection unit alternately operates the first and second memory control units every k frame periods for the writing operation based on the information of the number of frame periods.

4. The electrophoresis display of claim 1, wherein the controller further comprises a buffer unit configured to buffer a difference between the input timing of the first digital data from the system and the read and write timing of the first digital data of the first memory or the second memory.

5. The electrophoresis display of claim 4, wherein the buffer unit includes a First In First Out (FIFO) buffer.

* * * * *